US006129156A

United States Patent [19]

Boast et al.

[11] Patent Number: 6,129,156

[45] Date of Patent: Oct. 10, 2000

[54] METHOD FOR AUTOMATICALLY MOVING THE BLADE OF A MOTOR GRADER FROM A PRESENT BLADE POSITION TO A MIRROR IMAGE POSITION

[75] Inventors: Susan M. Boast; Michael I. Cline, both of Metamora; Matthew A. Hartman, Bloomington; Xiaojun Zhang, Peoria; Mark D. Shane, Princeville; Daniel E. Shearer, Metamora, all of Ill.

[73] Assignee: Caterpillar Inc., Peoria, Ill.

[21] Appl. No.: 09/216,180

[22] Filed: Dec. 18, 1998

[51] Int. Cl.[7] ..... E02F 3/76

[52] U.S. Cl. ..... 172/4.5; 172/2; 172/731; 172/796; 701/50

[58] Field of Search ..... 172/2, 4, 4.5, 781, 172/795, 796, 797; 701/50; 37/348, 382

[56] References Cited

U.S. PATENT DOCUMENTS

| | | | |
|---|---|---|---|
| 4,136,508 | 1/1979 | Coleman et al. | 56/208 |
| 4,221,266 | 9/1980 | Fardal | 172/4 |
| 4,733,355 | 3/1988 | Davidson et al. | 172/4 X |
| 4,744,218 | 5/1988 | Edwards et al. | 60/368 |
| 4,934,463 | 6/1990 | Ishida et al. | 172/4.5 |
| 4,955,437 | 9/1990 | Bohman | 172/1 |
| 5,356,259 | 10/1994 | Hanamoto et al. | 414/694 |
| 5,631,658 | 5/1997 | Gudat et al. | 701/50 X |
| 5,647,439 | 7/1997 | Burdick et al. | 172/4.5 |
| 5,735,352 | 4/1998 | Henderson et al. | 172/4.5 |
| 5,894,894 | 4/1999 | Szymczak | 172/2 |
| 5,905,968 | 5/1999 | Staub et al. | 701/50 X |
| 5,951,612 | 9/1999 | Sahm | 701/50 |
| 5,987,371 | 11/1999 | Bailey et al. | 701/50 |

*Primary Examiner*—Victor Batson

*Attorney, Agent, or Firm*—Howard & Howard; Jeffrey L. Myers

[57] ABSTRACT

A system and method for automatically moving the blade of a motor grader from a present blade position to a mirror image position. The method includes the steps of: providing an electronic controller, blade controls having position sensors, and an input switch; obtaining information from the position sensors indicating the position of the blade controls; determining the present blade position; receiving an input signal from the input switch requesting a mirror image position; calculating the mirror image position of the present blade position; and producing a control signal for actuating the blade controls to move the blade from the present blade position to the mirror image position.

10 Claims, 5 Drawing Sheets

METHOD FOR AUTOMATICALLY MOVING THE BLADE OF A MOTOR GRADER FROM A PRESENT BLADE POSITION TO A MIRROR IMAGE POSITION

TECHNICAL FIELD

The present invention relates generally to a method for automatically moving the blade of a motor grader from a present blade position to a mirror image position and, more particularly, for controlling the blade controls of a motor grader to automatically produce a mirror image of the current blade cutting angle, the current blade sideshift, and/or the current drawbar sideshift.

BACKGROUND ART

Motor graders are used primarily as a finishing tool to sculpt a surface of earth to a final arrangement. To perform such earth sculpting tasks, motor graders include a blade, also referred to as a moldboard or implement. The blade moves relatively small quantities of earth from side to side. Motor graders must produce a variety of final earth arrangements. As a result, the blade must be set to many different blade positions.

The blade may be adjusted for blade height, blade cutting angle, blade tip, blade sideshift, and drawbar sideshift. Accordingly, motor graders include several hand controls to operate the multiple blade adjustments. Positioning the blade of a motor grader is a complex and time consuming task. Frequently, a motor grader will spread material to one direction perpendicular to the path of travel. In other words, the motor grader will spread material across the area being graded, not straight ahead. Typically, this is accomplished by making a first pass over the material with the blade at a first blade position. The first blade position may be defined by the blade cutting angle, the blade sideshift, and/or the drawbar sideshift. At the end of the pass, the motor grader will need to turn around and make a second pass over the material. To spread the material in the same direction, the blade should be repositioned to a mirror image of the first pass. In other words, the blade position for the second pass should be a mirror image of the first blade position to continue to spread the material in the same direction. Thus, to increase efficiency, it is desirable to provide a method for controlling the blade controls to automatically produce a mirror image of the current blade position.

DISCLOSURE OF THE INVENTION

The present invention provides a method for automatically moving the blade of a motor grader from a present blade position to a mirror image position. The method includes the steps of: providing an electronic controller, blade controls having position sensors, and an input switch; obtaining information from the position sensors indicating the position of the blade controls; determining the present blade position; receiving an input signal from the input switch requesting a mirror image position; calculating the mirror image position of the present blade position; and producing a control signal for actuating the blade controls to move the blade from the present blade position to the mirror image position.

BEST MODE FOR CARRYING OUT THE INVENTION

Figure 1:
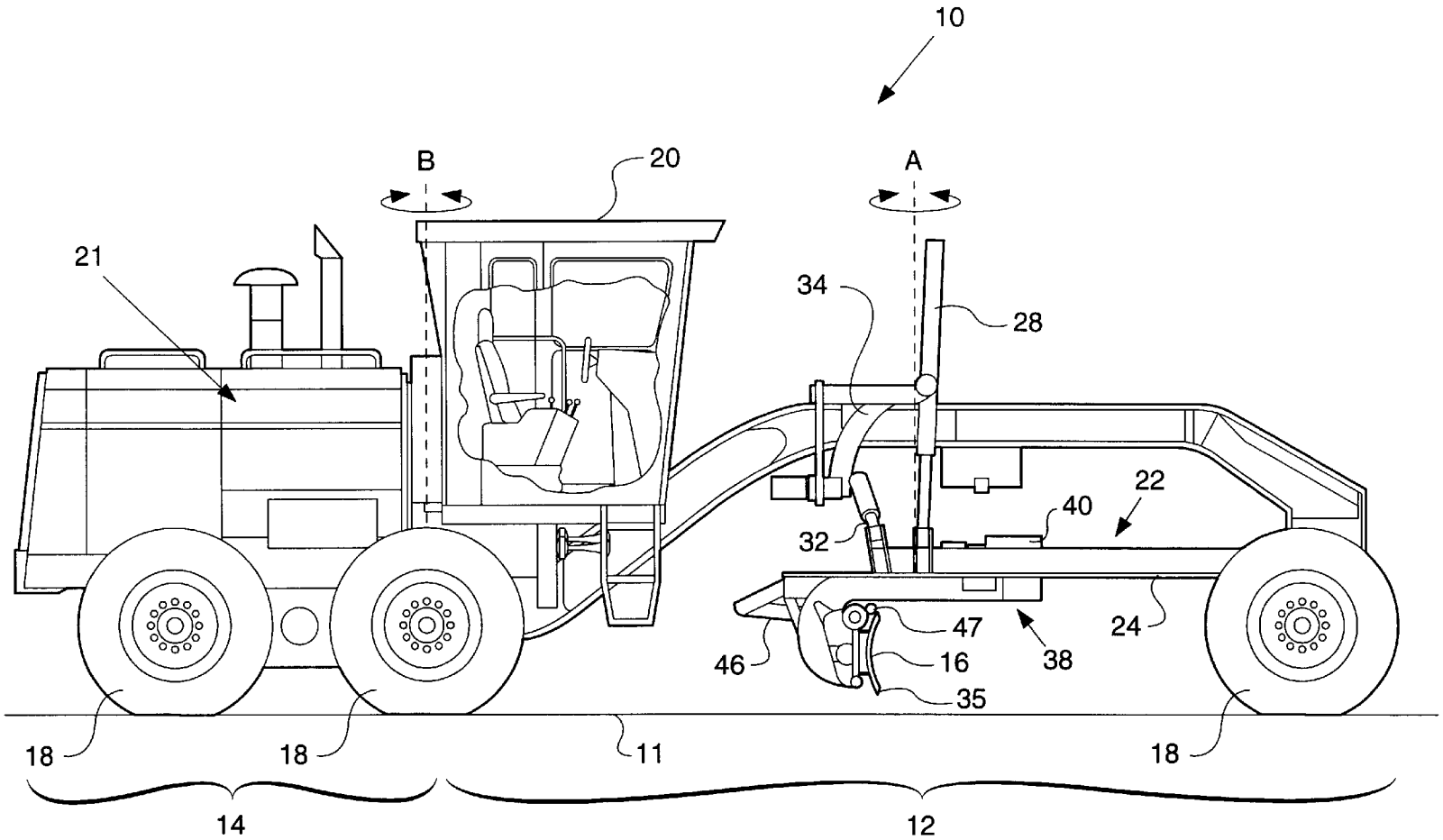
FIG. 1 is a side view of a motor grader.
Figure 2:
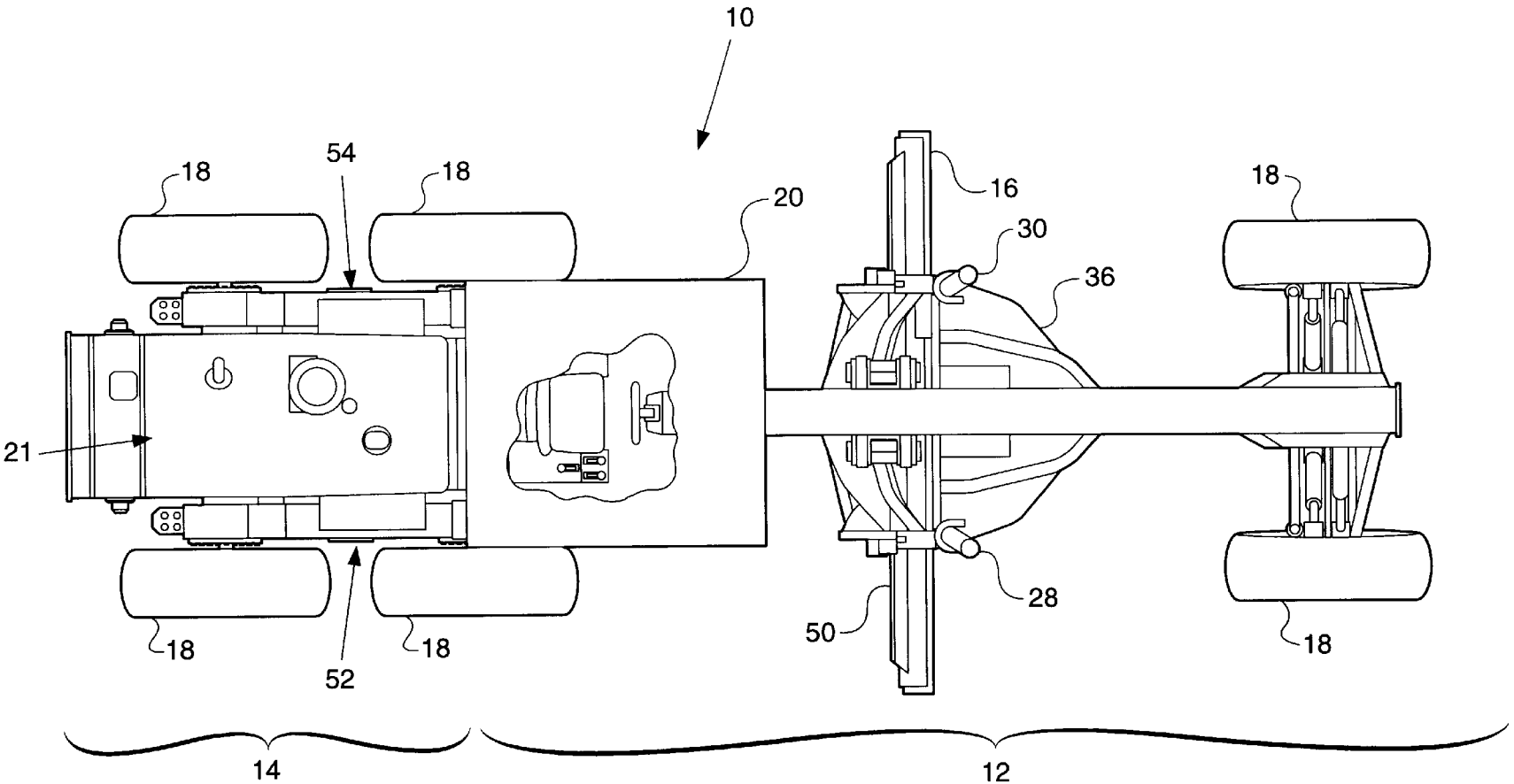
FIG. 2 is a top view of the motor grader.

Referring to the Figures, wherein like numerals indicate like or corresponding parts throughout the several views, a motor grader is shown generally at 10 in FIGS. 1 and 2. The motor grader 10 is used primarily as a finishing tool to sculpt a surface of earth 11 to a final arrangement. Rather than moving large quantities of earth in the direction of travel like other machines, such as a bulldozer, the motor grader 10 typically moves relatively small quantities of earth from side to side. In other words, the motor grader 10 typically moves earth across the area being graded, not straight ahead.

The motor grader 10 includes a front frame 12, a rear frame 14, and a blade 16. The front and rear frames 12 and 14 are supported by tires 18. An operator cab 20 containing the many controls necessary to operate the motor grader 10 is mounted on the front frame 12. An engine, shown generally at 21, is used to drive or power the motor grader 10. The engine 21 is mounted on the rear frame 14. The blade 16, sometimes referred to as a moldboard, is used to move earth. The blade 16 is mounted on a linkage assembly, shown generally at 22. The linkage assembly 22 allows the blade 16 to be moved to a variety of different positions relative to the motor grader 10. Starting at the front of the motor grader 10 and working rearward toward the blade 16, the linkage assembly 22 includes a drawbar 24.

The drawbar 24 is mounted to the front frame 12 with a ball joint. The position of the drawbar 24 is controlled by three hydraulic cylinders, commonly referred to as a right lift cylinder 28, a left lift cylinder 30, and a centershift cylinder 32. A coupling, shown generally at 34, connects the three cylinders 28, 30, and 32 to the front frame 12. The coupling 34 can be moved during blade repositioning but is fixed stationary during earthmoving operations. The height of the blade 16 with respect to the surface of earth 11 below the motor grader 10, commonly referred to as blade height, is controlled primarily with the right and left lift cylinders 28 and 30. The right and left lift cylinders 28 and 30 can be controlled independently and, thus, used to angle a bottom cutting edge 35 of the blade 16 relative to the surface of earth 11. The centershift cylinder 32 is used primarily to sideshift the drawbar 24, and all the components mounted to the end of the drawbar, relative to the front frame 12. This sideshift is commonly referred to as drawbar sideshift or circle centershift.

Figure 3:
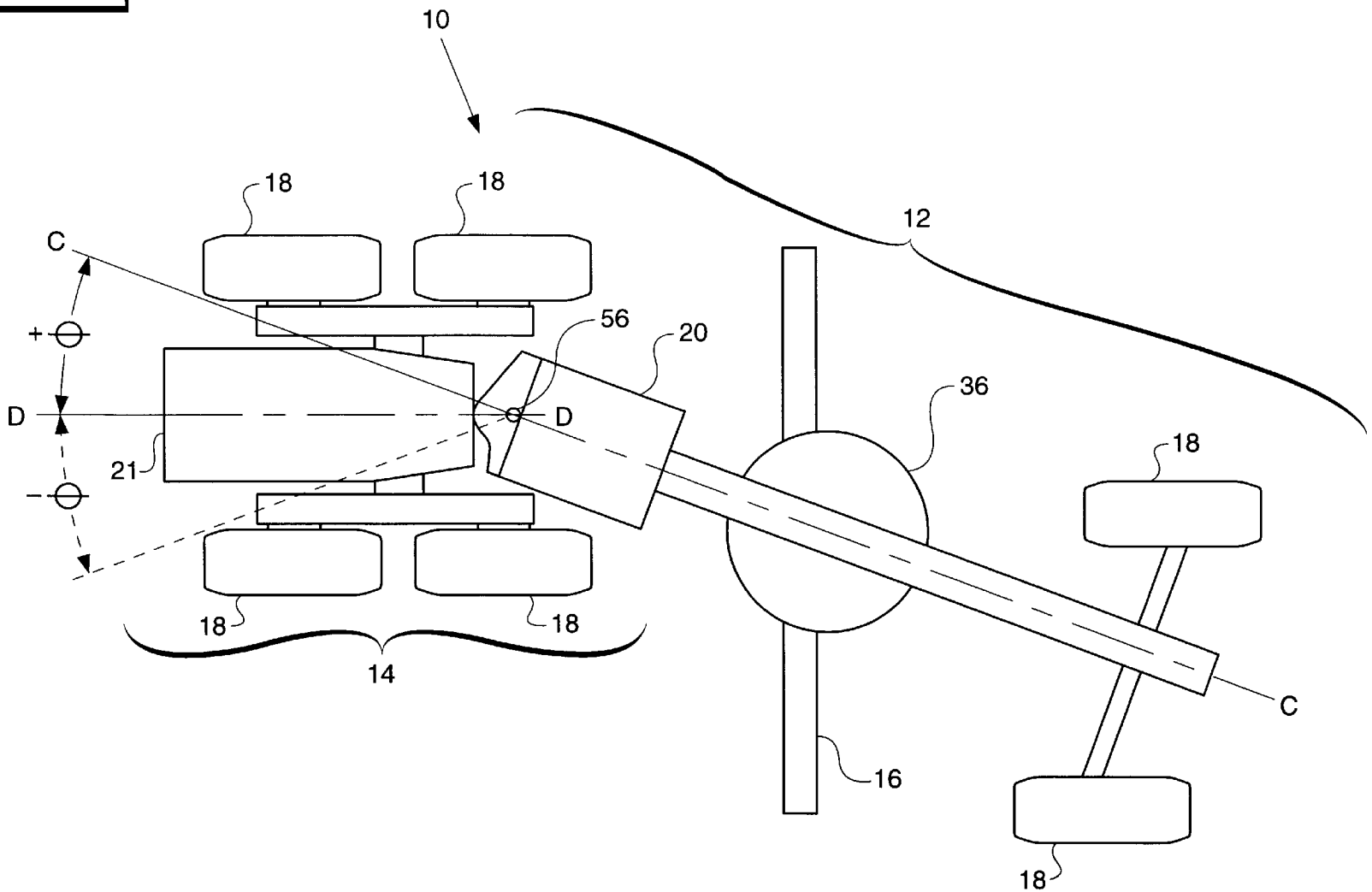
FIG. 3 is a top schematic view of the motor grader rotated to a full right articulation angle.

The drawbar 24 includes a large, flat plate, commonly referred to as a yoke plate 36, as shown in FIGS. 2 and 3. Beneath the yoke plate 36 is a large gear, commonly referred to as a circle 38. The circle 38 is rotated by a hydraulic motor, commonly referred to as a circle drive 40, as shown in FIG. 1. The rotation of the circle 38 by the circle drive 40, commonly referred to as circle turn, pivots the blade 16 about an axis A fixed to the drawbar 24 to establish a blade cutting angle. The blade cutting angle is defined as the angle of the blade 16 relative to the front frame 12. At a zero degree blade cutting angle, the blade 16 is aligned at a right angle to the front frame 12. In FIG. 2, the blade 16 is set at a zero degree blade cutting angle.

The blade 16 is mounted to a hinge on the circle 38 with a bracket. A blade tip cylinder 46 is used to pitch the bracket forward or rearward. In other words, the blade tip cylinder 46 is used to tip a top edge 47 of the blade 16 ahead of or behind the bottom cutting edge 35 of the blade 16. The position of the top edge 47 of the blade 16 relative to the bottom cutting edge 35 of the blade 16 is commonly referred to as blade tip.

The blade 16 is mounted to a sliding joint in the bracket allowing the blade 16 to be slid or shifted from side to side relative to the bracket or the circle 38. This side to side shift is commonly referred to as blade sideshift. A sideshift cylinder 50 is used to control the blade sideshift.

Referring now to FIG. 2, a right articulation cylinder, shown generally at 52, is mounted to the right side of the rear frame 14 and a left articulation cylinder, shown generally at 54, is mounted to the left side of the rear frame 14. The right and left articulation cylinders 52 and 54 are used to rotate the front frame 12 about an axis B shown in FIG. 1. The axis B is commonly referred to as the articulation axis. In FIG. 2, the motor grader 10 is positioned in a neutral or zero articulation angle.

FIG. 3 is a top schematic view of the motor grader 10 with the front frame 12 rotated to a full right articulation angle +θ. The articulation angle θ is formed by the intersection of the longitudinal axis C of the front frame 12 and the longitudinal axis D of the rear frame 14. An articulation joint 56 connects the front frame 12 and the rear frame 14. A rotary sensor, used to measure the articulation angle θ, is positioned at the articulation joint 56. A full left articulation angle −θ, shown in phantom lines in FIG. 3, is a mirror image of the full right articulation angle +θ. The motor grader 10 may be operated with the front frame 12 rotated to the full right articulation angle +θ, the full left articulation angle −θ, or any angle therebetween.

Figure 4:
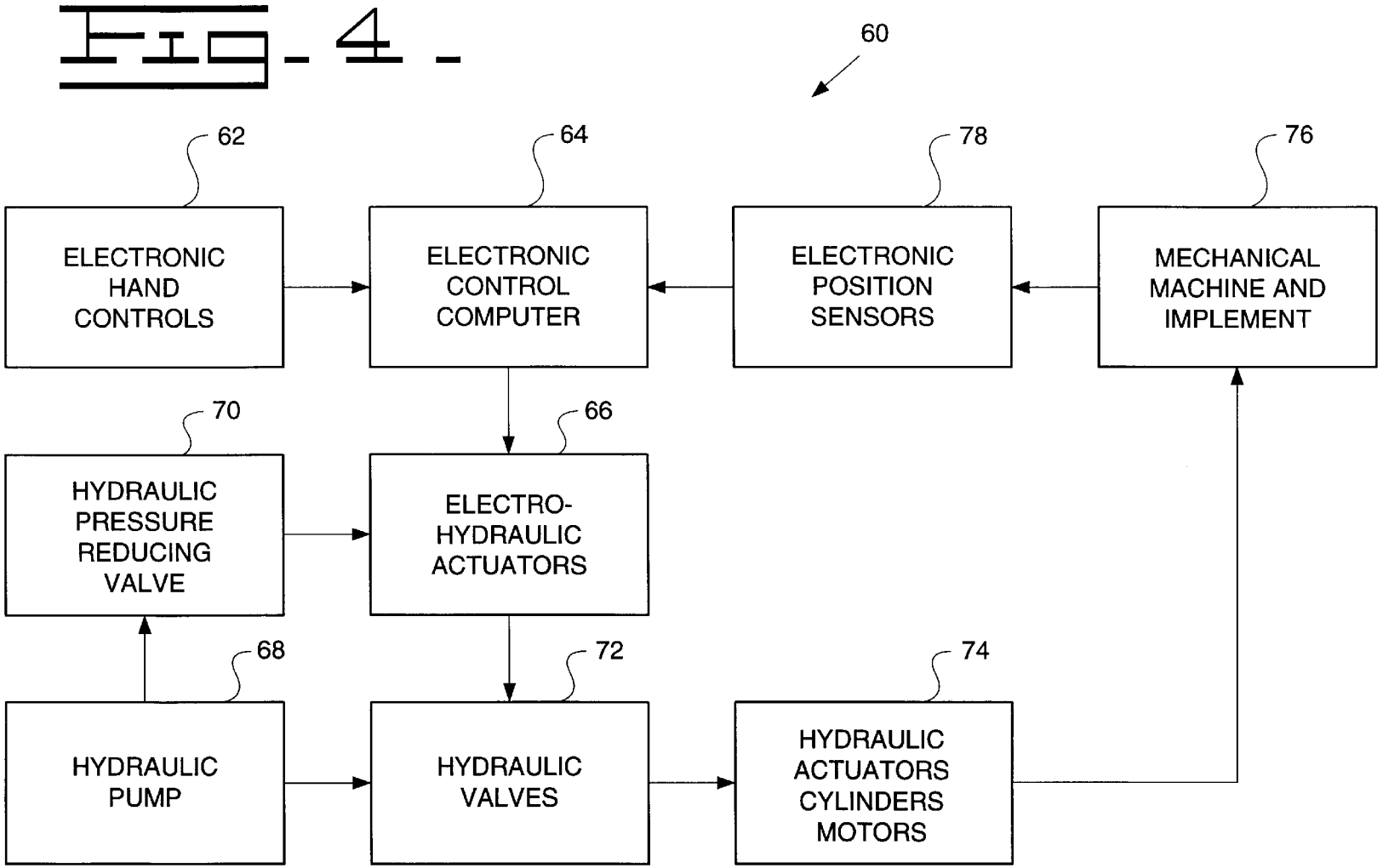
FIG. 4 is a schematic block diagram of an electro-hydraulic control system for the motor grader.

FIG. 4 is a schematic block diagram of an electro-hydraulic control system 60 for the motor grader 10. The control system 60 is designed to control the blade 16 and the articulation angle θ. The system 60 includes electronic hand controls, represented by block 62, which transform the actions of an operator's hands into electrical input signals. These input signals carry operational information to an electronic control computer, represented by block 64.

The control computer 64 receives the electrical inputs signals produced by the hand controls 62, processes the operational information carried by the input signals, and transmits control signals to drive solenoids in electro-hydraulic actuators, represented by block 66.

The hydraulic portion of the control system 60 requires both high hydraulic pressure and low pilot pressure. High hydraulic pressure is provided by a hydraulic pump, represented by block 68. The hydraulic pump 68 receives a rotary motion, typically from the engine 21 of the motor grader 10, and produces high hydraulic pressure. Low pilot pressure is provided by a hydraulic pressure reducing valve, represented by block 70. The hydraulic pressure reducing valve 70 receives high hydraulic pressure from the hydraulic pump 68 and supplies low pilot pressure to the electro-hydraulic actuators 66.

Each electro-hydraulic actuator 66 includes an electrical solenoid and a hydraulic valve. The solenoid receives control signals from the electronic control computer 64 and produces a controlled mechanical movement of a core stem of the actuator 66. The hydraulic valve receives both the controlled mechanical movement of the core stem of the actuator 66 and low pilot pressure from the hydraulic pressure reducing valve 70 and produces controlled pilot hydraulic pressure for hydraulic valves, represented by block 72.

The hydraulic valves 72 receive both controlled pilot hydraulic pressure from the electro-hydraulic actuators 66 and high hydraulic pressure from the hydraulic pump 68 and produce controlled high hydraulic pressure for hydraulic actuators, cylinders, and motors, represented by block 74.

The hydraulic actuators, cylinders, and motors 74 receive controlled high hydraulic pressure from the hydraulic valves 72 and produce mechanical force to move the front frame 12 of the grader 10 and several mechanical linkages, represented by block 76. As described above, movement of the front frame 12 of the grader 10 with respect to the rear frame 14 of the grader 10 establishes the articulation angle θ. Movement of the mechanical linkages establishes the position of the blade 16.

Each hydraulic actuator, cylinder, and motor 74, such as the lift cylinders 28 and 30 and the circle drive motor 40, includes an electronic position sensor, represented by block 78. The electronic position sensors 78 transmit information regarding the position of its respective hydraulic actuator, cylinder, or motor 76 to the electronic control computer 64. In this manner, the control computer 64 can determine the position of the blade 16. The control computer 64 further receives articulation angle information from the rotary sensor, also represented by block 78, positioned at the articulation joint 56. With such position and angle information, the control computer 64 can perform additional operations.

In accordance with the scope of the present invention, such operations include controlling the circle drive 40 to automatically produce a mirror image of the current blade cutting angle, controlling the sideshift cylinder 50 to automatically produce a mirror image of the current blade sideshift, and controlling the centershift cylinder 32 to automatically produce a mirror image of the current drawbar sideshift. Thus, the present invention provides a method for automatically moving the blade 16 of the motor grader 10 from a present blade position to a mirror image position. The method includes the steps of: providing an electronic controller, blade controls having position sensors, and an input switch; obtaining information from the position sensors indicating the position of the blade controls; determining the present blade position; receiving an input signal from the input switch requesting a mirror image position; calculating the mirror image position of the present blade position; and producing a control signal for actuating the blade controls to move the blade from the present blade position to the mirror image position.

Figure 5:
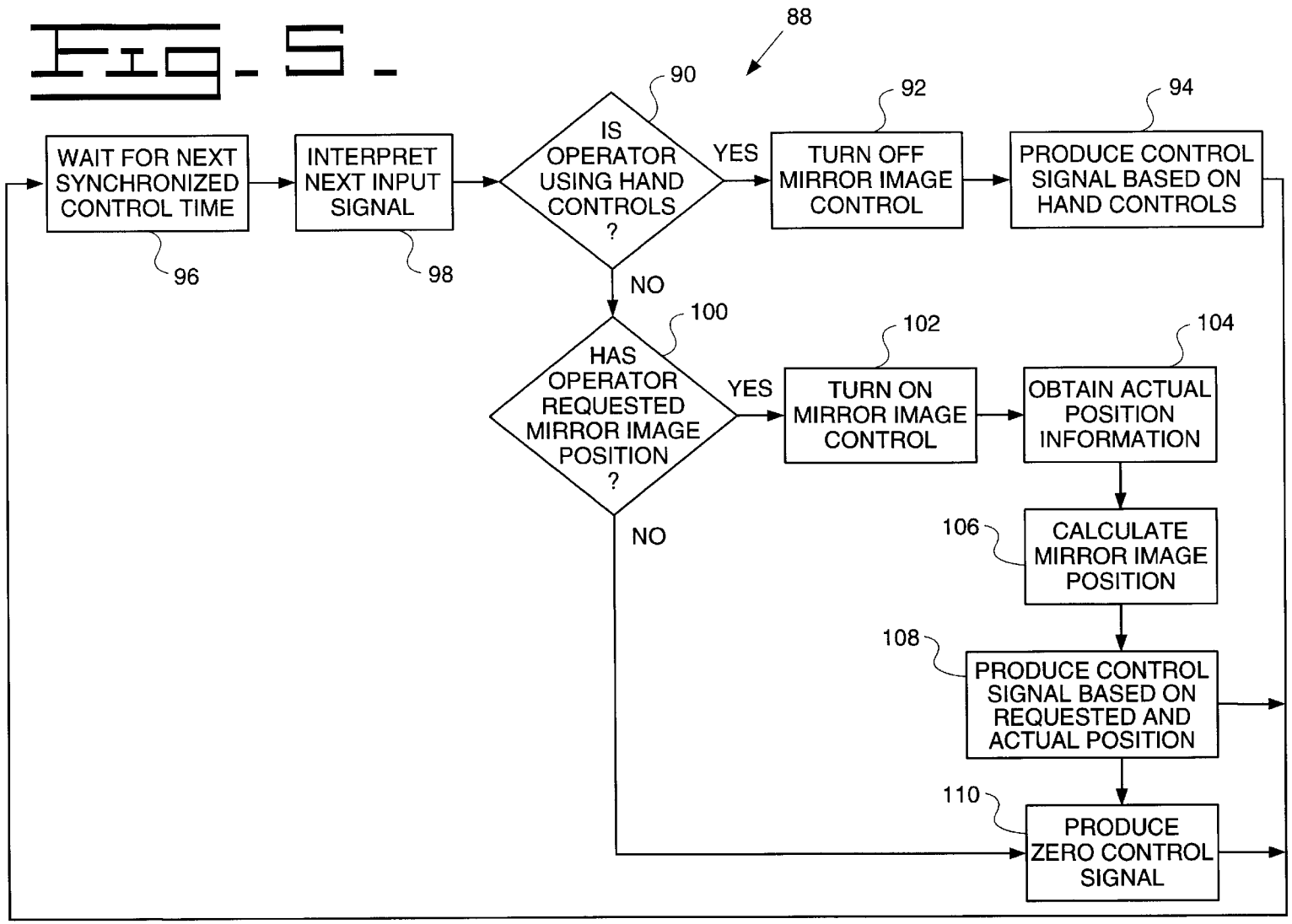
FIG. 5 is a flow chart illustrating a method for automatically moving the blade of the motor grader from a present blade position to a mirror image position in accordance with the present invention.

Referring now to FIG. 5, a flow chart illustrating a preferred method 88 for automatically moving the blade of the motor grader from a present blade position to a mirror image position is shown. As will be appreciated by one of ordinary skill in the art, although the flow chart illustrates sequential steps, the particular order of processing is not important to achieving the objects of the present invention. As will also be recognized, the method illustrated may be performed in software, hardware, or a combination of both as in a preferred embodiment of the present invention.

In the preferred method 88, an operator is provided with both automatic and manual or hand controls to adjust the position of the blade. Initially, it is determined whether the operator is using the hand controls, as represented by block 90. If the operator is using the hand controls, the automatic mirror image position control is turned off, as illustrated by block 92. The control computer produces and transmits a control signal to actuate the respective control, i.e. the circle drive, the sideshift cylinder, and/or the centershift cylinder, in accordance with the action requested by the manual controls, as represented by 94. The program waits for the next synchronized control time, as illustrated by 96, and then interprets the next automatic or hand control input signal, as represented by block 98.

If the operator is not using the hand controls, it is determined if the operator has requested the automatic mirror image position control, as illustrated by block 100. If the operator has requested the automatic mirror image position control, the automatic mirror image position control is turned on, as represented by block 102. Information regarding the actual position of the blade controls, i.e. the circle drive, the sideshift cylinder, and the centershift cylinder, is obtained by the controller, as illustrated by block 104. The controller calculates a mirror image position of the present blade position, as represented by block 106. Using this position information, the control computer produces and transmits a control signal designed to achieve the mirror image position requested by the automatic mirror image position control, as illustrated by block 108. The control signal actuates the blade controls, i.e. the circle drive, the sideshift cylinder, and/or the centershift cylinder, to automatically move the blade from its actual blade position to the mirror image of the actual blade position. The program waits for the next synchronized control time, as represented by 96, and then interprets the next automatic or hand control input signal, as illustrated by block 98.

If the operator has not requested automatic mirror image position control, the control computer produces and transmits a zero control signal, as represented by block 110. The program waits for the next synchronized control time, as illustrated by 96, and then interprets the next automatic or hand control input signal, as represented by block 98.

One of ordinary skill in the art will recognize that the present invention may also control the articulation cylinders 52 and 54 to produce a mirror image position of the articulation angle θ, and the lift cylinder 28 and 30 to produce a mirror image position of the angle of the bottom cutting edge 35 of the blade 16.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

Industrial Applicability

The present invention relates generally to a method for automatically moving the blade of a motor grader, having an electronic controller, blade angle controls including position sensors, and an input switch, from a present blade position to a mirror image position. By obtaining the position of the blade controls from the position sensors, a mirror image of the present blade position can be calculated by the controller. Upon receipt of an input signal from the input switch requesting the mirror image position, the controller produces a unique control signal to actuate the blade controls and, thereby, automatically move the blade from its present blade position to the mirror image position. In this manner, an operator can simply activate the input switch to automatically move the blade from the present blade position to a mirror image position. In operation, this invention will simplify the spread of a material in one direction across an area to be graded as the motor grader is driven back and forth across the area.

What is claimed is:

1. A method for automatically moving the blade of a motor grader from a present blade position to a mirror image position comprising the steps of:

providing an electronic controller, blade controls having position sensors, and an input switch;

obtaining information from the position sensors indicating a position of the blade controls;

determining the present blade position;

receiving an input signal from the input switch requesting a mirror image position;

calculating the mirror image position of the present blade position; and producing a control signal for actuating the blade controls to move the blade from the present blade position to the mirror image position.

2. A method as set forth in claim 1 wherein the step of determining the present blade position includes the step of determining a present blade cutting angle.

3. A method as set forth in claim 2 wherein the step of calculating the mirror image position of the present blade position includes the step of calculating the mirror image position of the present blade cutting angle.

4. A method as set forth in claim 3 wherein the blade controls include a circle drive and wherein the step of producing a control signal for actuating the blade controls to move the blade from the present blade position to the mirror image position includes the step of producing a control signal for actuating the circle drive to rotate the blade from the present blade cutting angle to the mirror image position.

5. A method as set forth in claim 1 wherein the step of determining the present blade position includes the step of determining a present blade sideshift.

6. A method as set forth in claim 5 wherein the step of calculating the mirror image position of the present blade position includes the step of calculating the mirror image position of the present blade sideshift.

7. A method as set forth in claim 6 wherein the blade controls include a sideshift cylinder and wherein the step of producing a control signal for actuating the blade controls to move the blade from the present blade position to the mirror image position includes the step of producing a control signal for actuating the sideshift cylinder to shift the blade from the present blade sideshift to the mirror image position.

8. A method as set forth in claim 1 wherein the step of determining the present blade position includes the step of determining a present drawbar sideshift.

9. A method as set forth in claim 8 wherein the step of calculating the mirror image position of the present blade position includes the step of calculating a mirror image position of the present drawbar sideshift.

10. A method as set forth in claim 9 wherein the blade controls include a centershift cylinder and wherein the step of producing a control signal for actuating the blade controls to move the blade from the present blade position to the mirror image position includes the step of producing a control signal for actuating the centershift cylinder to shift the blade from the present drawbar sideshift to the mirror image position.

* * * * *